US011020631B2

(12) United States Patent
Walker et al.

(10) Patent No.: US 11,020,631 B2
(45) Date of Patent: Jun. 1, 2021

(54) SYSTEMS, DEVICES, AND METHODS INCLUDING A SPINAL RESISTANCE ASSEMBLY

(71) Applicant: Orthopedic Wellness Laboratories, Inc., Woodinville, WA (US)

(72) Inventors: Brad H. Walker, Woodinville, WA (US); Joseph E. Skidmore, Woodinville, WA (US); Aaron D. Poole, Woodinville, WA (US); Michael F. Kahn, Woodinville, WA (US); Daniel A. Lazar, Woodinville, WA (US); Jerrold L. Gray, Woodinville, WA (US); Rajen N. Shah, Woodinville, WA (US); Roy P. Diaz, Woodinville, WA (US)

(73) Assignee: Orthopedic Wellness Laboratories, Inc., Woodinville, WA (US)

( * ) Notice: Subject to any disclaimer, the term of this patent is extended or adjusted under 35 U.S.C. 154(b) by 0 days.

(21) Appl. No.: 16/627,878

(22) PCT Filed: Sep. 28, 2018

(86) PCT No.: PCT/US2018/053391
§ 371 (c)(1),
(2) Date: Dec. 31, 2019

(87) PCT Pub. No.: WO2019/067877
PCT Pub. Date: Apr. 4, 2019

(65) Prior Publication Data

US 2020/0222754 A1 Jul. 16, 2020

Related U.S. Application Data

(63) Continuation of application No. 16/128,499, filed on Sep. 11, 2018, now abandoned.
(Continued)

(51) Int. Cl.
*A63B 23/025* (2006.01)
*A63B 24/00* (2006.01)
(Continued)

(52) U.S. Cl.
CPC ..... *A63B 23/025* (2013.01); *A63B 21/005* (2013.01); *A63B 21/008* (2013.01);
(Continued)

(58) Field of Classification Search
CPC ..... A63B 23/025; A63B 23/0238; A63B 21/00058; A63B 21/00076;
(Continued)

(56) References Cited

U.S. PATENT DOCUMENTS 4,768,779 A * 9/1988 Oehman, Jr. ..... A63B 23/025 482/10
4,893,808 A * 1/1990 McIntyre ..... A63B 23/025 482/10
(Continued)

*Primary Examiner* — Megan Anderson
*Assistant Examiner* — Kathleen Vermillera
(74) *Attorney, Agent, or Firm* — Lee & Hayes, P.C.

(57) ABSTRACT

Systems, devices, and methods are described for providing, among other things, a neck and spine strengthening device. The strengthening device includes a spinal resistance assembly configured to apply a resist force or to resist rotation about at least a first axis, and a head affixing assembly configured to secure to a head of a user during use. The strengthening device is instrumented with sensors and an embedded computing system configured to securely exchange exercise performance and configuration data with local client devices, and to monitor and record exercise activity and exercise performance data.

12 Claims, 10 Drawing Sheets

Related U.S. Application Data

(60) Provisional application No. 62/566,410, filed on Sep. 30, 2017.

(51) Int. Cl.

| | |
|---|---|
| ***A63B 21/005*** | (2006.01) |
| ***A63B 71/06*** | (2006.01) |
| ***A63B 21/00*** | (2006.01) |
| ***A63B 21/008*** | (2006.01) |
| ***A63B 21/16*** | (2006.01) |

(52) U.S. Cl.
CPC .... *A63B 21/0085* (2013.01); *A63B 21/00192* (2013.01); *A63B 21/1627* (2013.01); *A63B 24/0087* (2013.01); *A63B 71/0622* (2013.01); *A63B 2220/13* (2013.01); *A63B 2220/40* (2013.01); *A63B 2220/803* (2013.01); *A63B 2220/808* (2013.01)

(58) Field of Classification Search
CPC ..... A63B 21/00069; A63B 21/00178; A63B 21/00192; A63B 21/00196; A63B 21/005; A63B 21/0051; A63B 21/0052; A63B 21/0053; A63B 21/0056; A63B 21/0057; A63B 21/008; A63B 21/0083; A63B 21/00845; A63B 21/0085; A63B 21/0087; A63B 21/012; A63B 21/02; A63B 21/022; A63B 21/023; A63B 21/0525; A63B 21/1618; A63B 21/1627; A63B 21/1636; A63B 21/1645; A63B 21/1654; A63B 21/1663; A63B 21/22–227; A63B 21/4003; A63B 21/4049; A63B 24/0003; A63B 24/0006; A63B 24/0062; A63B 24/0075; A63B 24/0087; A63B 24/00–0087; A63B 71/0622; A63B 2024/0093; A63B 2024/0009–0096; A63B 2220/13; A63B 2220/803; A63B 2220/40; A63B 2220/808; A63B 2220/10; A63B 2220/16; A63B 2220/17
See application file for complete search history.

(56) References Cited

U.S. PATENT DOCUMENTS

| | | | | |
|---|---|---|---|---|
| 8,636,631 | B2 * | 1/2014 | Carlson | A63B 21/156 482/139 |
| 10,188,159 | B2 * | 1/2019 | Armour | A41D 13/0512 |
| 2004/0033863 | A1 * | 2/2004 | Carlson | A63B 21/023 482/10 |
| 2004/0033869 | A1 * | 2/2004 | Carlson | A63B 21/4003 482/121 |
| 2004/0220500 | A1 * | 11/2004 | Dahl | A61B 5/1121 601/5 |
| 2017/0361165 | A1 * | 12/2017 | Miller | A63B 24/0006 |
| 2020/0038703 | A1 * | 2/2020 | Cleary | A63B 21/0058 |

* cited by examiner

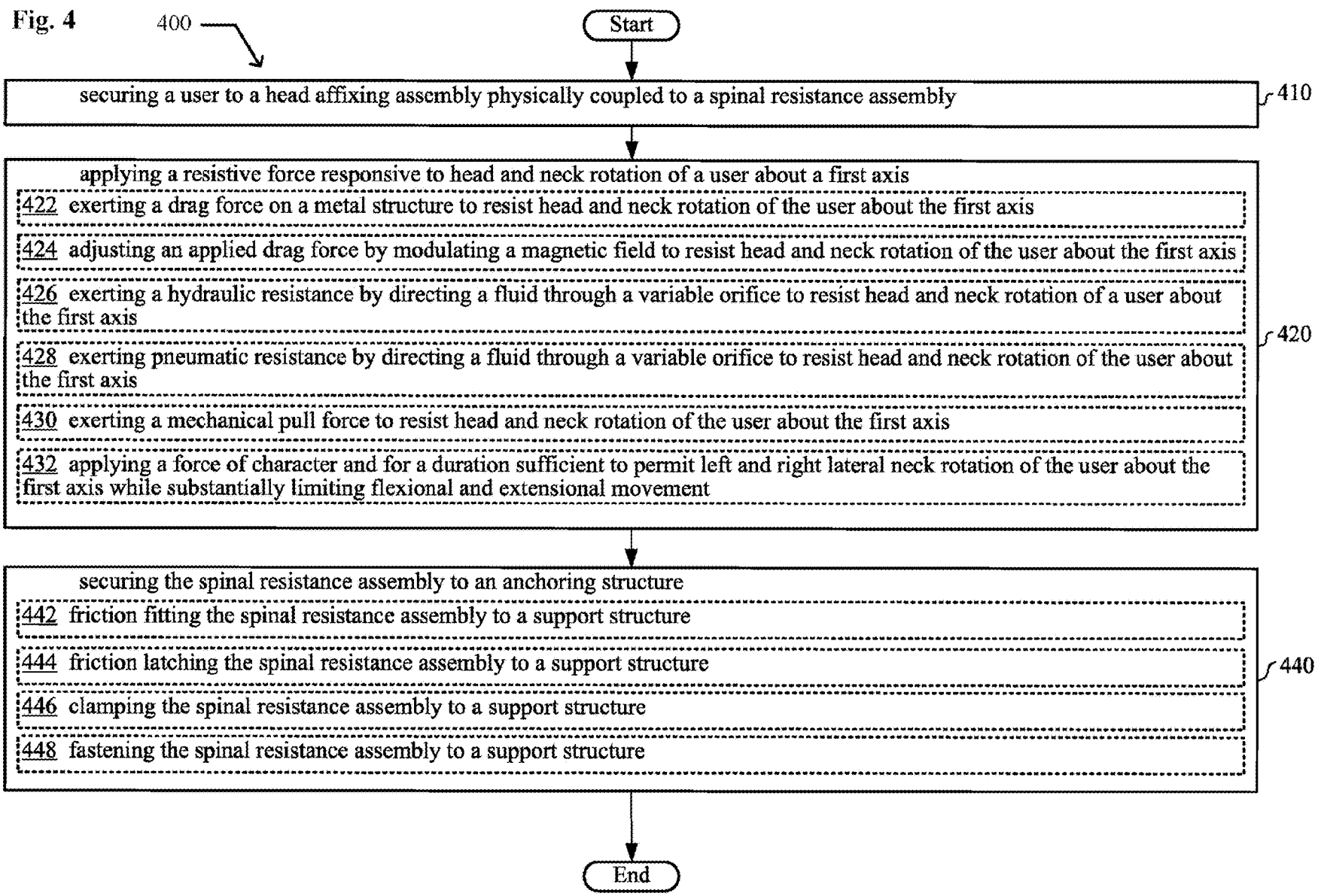
Fig. 4
400
Start
410
securing a user to a head affixing assembly physically coupled to a spinal resistance assembly
420
applying a resistive force responsive to head and neck rotation of a user about a first axis
422 exerting a drag force on a metal structure to resist head and neck rotation of the user about the first axis
424 adjusting an applied drag force by modulating a magnetic field to resist head and neck rotation of the user about the first axis
426 exerting a hydraulic resistance by directing a fluid through a variable orifice to resist head and neck rotation of a user about the first axis
428 exerting pneumatic resistance by directing a fluid through a variable orifice to resist head and neck rotation of the user about the first axis
430 exerting a mechanical pull force to resist head and neck rotation of the user about the first axis
432 applying a force of character and for a duration sufficient to permit left and right lateral neck rotation of the user about the first axis while substantially limiting flexional and extensional movement
440
securing the spinal resistance assembly to an anchoring structure
442 friction fitting the spinal resistance assembly to a support structure
444 friction latching the spinal resistance assembly to a support structure
446 clamping the spinal resistance assembly to a support structure
448 fastening the spinal resistance assembly to a support structure
End

SYSTEMS, DEVICES, AND METHODS INCLUDING A SPINAL RESISTANCE ASSEMBLY

CROSS REFERENCE TO RELATED APPLICATIONS

This application is a 371 National Stage Application of PCT/US18/53391, filed Sep. 28, 2018, which claims priority to U.S. application Ser. No. 16/128,449 filed Sep. 11, 2018, which claims priority to U.S. Provisional Application No. 62/566,410 filed Sep. 30, 2017, which are hereby incorporated by reference in its entirety.

SUMMARY

In an aspect, the present disclosure is directed to, among other things, a neck strengthening device. In an embodiment, the neck strengthening device includes a spinal resistance assembly having at least one resistance component configured to resist rotation about a first axis. In an embodiment, the neck strengthening device includes a spinal resistance assembly having at least one resistance component configured to resist lateral rotation of the neck during use. In an embodiment, the neck strengthening device includes a device securing assembly configured to physically anchor the device to an anchoring structure. In an embodiment, the neck strengthening device includes a head affixing assembly physically coupled to the spinal resistance assembly. In an embodiment, the head affixing assembly is configured to secure to a head of a user (e.g., person, patient, athlete, etc.) during use.

In an aspect, the present disclosure is directed to, among other things, a spinal resistance strengthening system. In an embodiment, the spinal resistance strengthening system includes circuitry configured generate user-specific neck strengthening information. In an embodiment, the spinal resistance strengthening system includes circuitry configured to exchange neck strengthening information with one or more of a remote client device, server, network, enterprise server, and the like. In an embodiment, the spinal resistance strengthening system includes circuitry configured to initiate a discovery protocol that allows the spinal resistance strengthening device and a client device to find each other and negotiate one or more pre-shared keys. In an embodiment, the spinal resistance strengthening system includes circuitry configured to initiate a discovery protocol that allows the spinal resistance strengthening device and a client device to find each other and establish an encrypted secure connection. In an embodiment, the spinal resistance strengthening system includes circuitry configured to exchange neck strengthening information with a remote client device. In an embodiment, the spinal resistance strengthening system includes circuitry configured to exchange anonymized and encrypted neck strengthening information with a remote client device.

In an aspect, the present disclosure is directed to, among other things, a strengthening device. In an embodiment, the neck strengthening device includes a resistance assembly having at least one resistance component configured to resist movement about a first axis. In an embodiment, the neck strengthening device includes an affixing assembly physically coupled to the resistance assembly, the affixing assembly configured to secure to a body part of a user. In an embodiment, the neck strengthening device includes a device securing assembly configured to physically anchor the device to an anchoring structure.

BRIEF DESCRIPTION OF THE FIGURES

FIG. 4 shows a flow diagram of a method according to one embodiment.

Figure 1A:
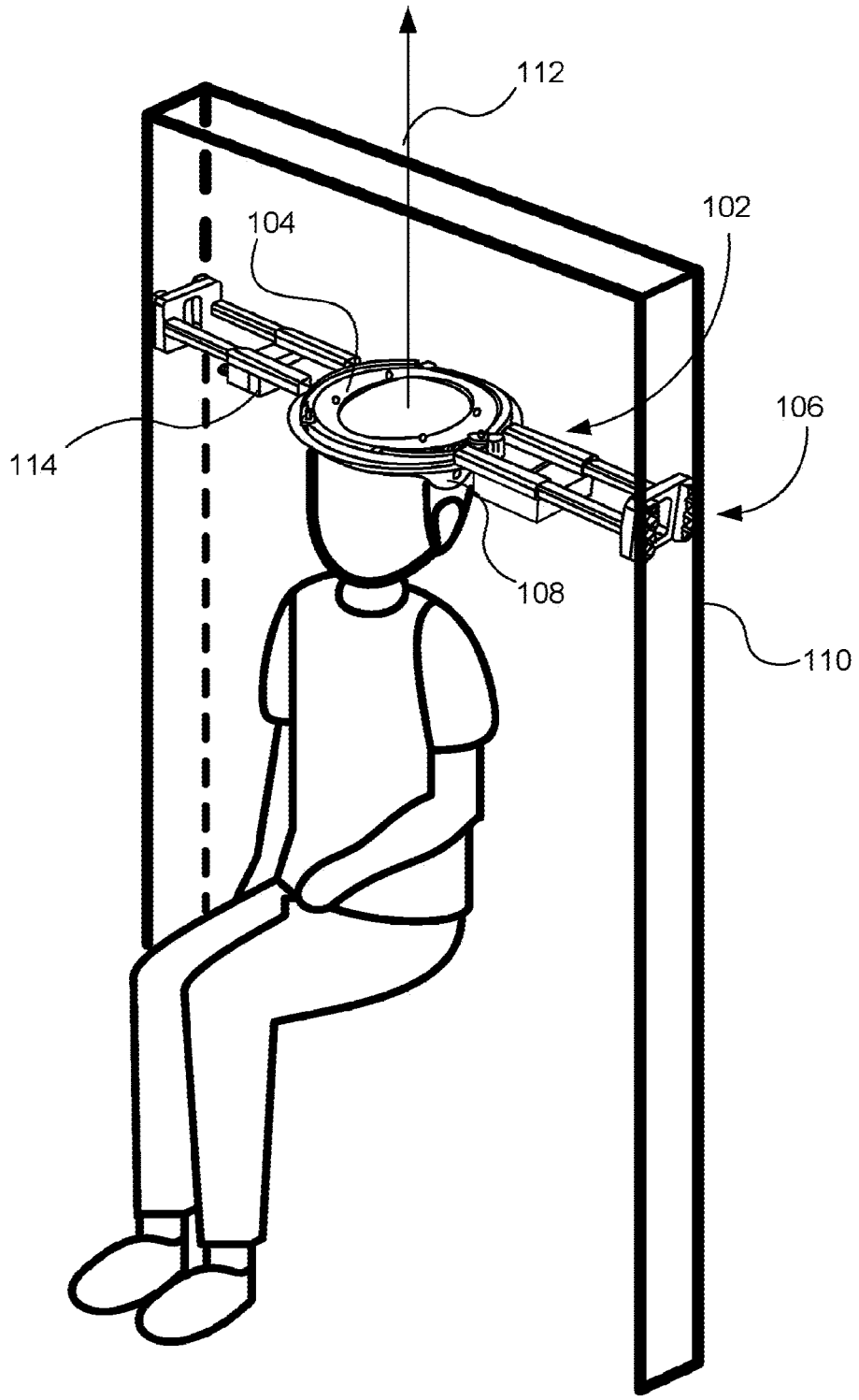
FIGS. 1A-1E are perspective views of a strengthening device according to one or more embodiments.
Figure 1B:
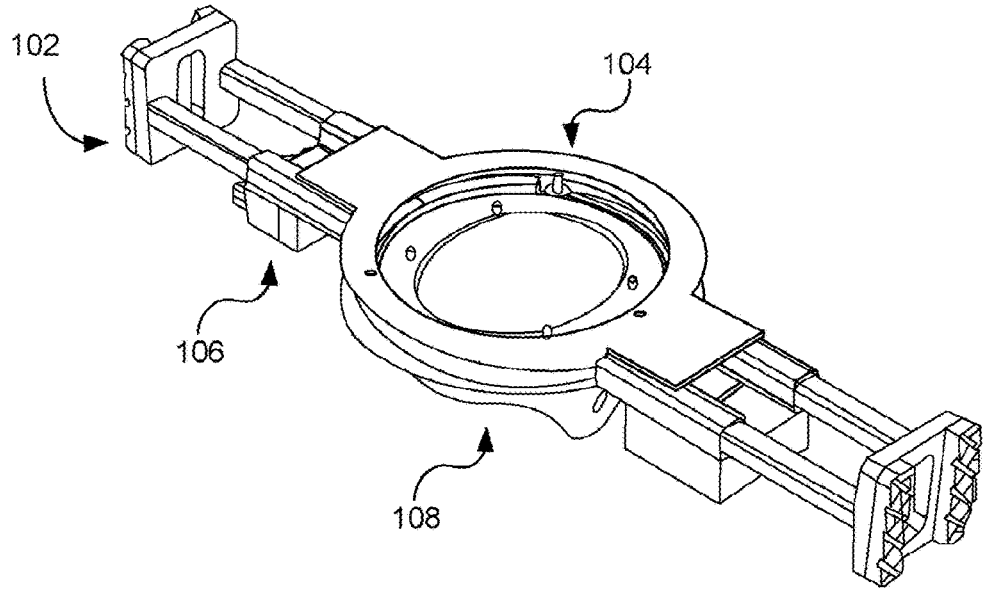

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

DETAILED DESCRIPTION

Musculoskeletal disorders are the second most common cause of disability worldwide, measured by years lived with disability. Storheim K, Zwart J A *Musculoskeletal disorders and the global burden of disease study*. Ann Rheumatic Dis 73: 949-950 (2014); see also Hoy D, March L, Brooks P, et al. *The global burden of low back pain: estimates from the Global Burden of Disease* 2010 *study*. Ann Rheum Dis 2014; 73:968-74. The most common musculoskeletal disorders are neck and low back pain. Neck pain plagues approximately a quarter of the population at any given time, resulting in increased medical costs, loss of productivity, and adds to the proliferation of pain medications.

Neck pain results from many causes including degenerative conditions, trauma, and sports injuries. Injury and degeneration of the cervical spine have also been shown to cause tension headaches, nerve injury in the neck. These conditions are still poorly understood, and clinicians are often left with a trial and error strategy regarding diagnostic investigation and treatment.

Systematic reviews reveal that existing treatments have only small effects at best, regardless of whether the intervention is based on a biological, psychological, or social approaches. Accordingly, there is the potential for better management by implementing effective health promoting actions and evidence supporting the recommendation of preventive measures such as weight loss and exercise for low back pain. Storheim K, Zwart J A *Musculoskeletal disorders and the global burden of disease study*. Ann Rheumatic Dis 73: 949-950 (2014).

Degenerative disc disease and neck injuries, including whiplash, result in loss of curvature of the spine and decreases in range of motion. The neck moves in multiple planes including flexion and extension and rotation. Many devices allow strengthening of flexion and extension, however increasing rotational strength and mobility is critical to preventing and recovering from age-related problems, motor vehicle accidents, and sports related incidents. Recent studies have also shown that increased neck strength decreases the incidence of sports concussions. There is no device currently available which provides a constant resistance in rotation for the cervical spine. Accordingly, the present disclosure details one or more methodologies or technologies that allow user, patients, and athletes to increase rotational strength and improve mobility in multiple axes. Increased neck strength and mobility results in quicker recovery from injury and prevents traumatic neck and head injuries.

In an embodiment, the present disclosure details one or more methodologies or technologies that utilizes a novel approach, employing a variable applied force, to provide constant resistance to the cervical spine about one or more axes or planes of movement. In an embodiment, this not only allows for strengthening in both the traditional flexion and extension planes, but also uniquely provides constant resistance in the rotational axis.

In an embodiment, the present disclosure details one or more methodologies or technologies including a device configured to provide a distraction movement which can be used to decompress an injured spine. In an embodiment, such complementary exercises result in balanced strengthening program for the cervical spine which maximizes the neck's range of motion and prevents injury.

FIGS. 1A-1E show a strengthening device 102 in which one or more methodologies or technologies can be implemented such as, for example, providing constant resistance to lateral rotation of the cervical spine. In an embodiment, the strengthening device 102 includes a spinal resistance assembly 104 including at least one resistance component configured to resist rotation about a first axis 112. In an embodiment, the strengthening device 102 includes a device securing assembly 106 configured to physically anchor the device to an anchoring structure 110. In an embodiment, the strengthening device 102 includes a head affixing assembly 108 physically coupled to the spinal resistance assembly 104, the head affixing assembly 108 configured to secure to a head of a user.

In an embodiment, the strengthening device 102 is configured and dimensioned to be portable. For example, in an embodiment, the strengthening device 102 is made from lightweight materials and includes collapsible structures for ease of portability. In an embodiment, the strengthening device 102 is configured for home use.

In an embodiment, the strengthening device 102 includes a resistance assembly 104 configured to permit left and right lateral neck rotation of a user about the first axis while substantially limiting flexional and extensional movement. For example, during operation, a user experiences a resistive force about the first axis as the user rotate neck and head, which helps to exercise and strengthen the neck and spinal muscles. Non-limiting example of neck and spinal muscles include longissimus capitis, rectus capitis posterior major, rectus capitis posterior minor, scalene muscles, semispinalis, splenius capitis, sternocleidomastoid, and the like.

In an embodiment, the spinal resistance assembly 104 is configured to permit lateral neck rotation of a user about the first axis while substantially limiting flexional and extensional movement of the head and neck. In an embodiment, the spinal resistance assembly 104 includes one or more of at least one resistance component (e.g., device, mechanism, apparatus, etc.), which may be: a mechanical component, an electromechanical component, a magnetic component, an electromagnetic component, a hydraulic component, or a pneumatic component configured to resist rotation about the first axis. Various examples of resistance components included in the spinal resistance assembly 104 to resist movement about an axis (e.g., a first axis, a second axis, a third axis, etc.) are described hereinafter. For example, in an embodiment, the spinal resistance assembly 104 includes a magnetic component configured to exert a drag force on a metal structure to resist head and neck rotation of a user about the first axis.

In an embodiment, the spinal resistance assembly 104 includes an electromagnetic component configured to exert a drag force on a metal structure to resist head and neck rotation of a user about the first axis. In an embodiment, the spinal resistance assembly 104 includes a magnetic component configured to adjust an applied drag force by modulating or varying a magnetic field. In an embodiment, the spinal resistance assembly 104 includes a magnetic component configured to adjust an applied drag force by moving a magnet further or closer to a ferromagnetic element.

In an embodiment, the spinal resistance assembly 104 includes a magnetic component configured to adjust an applied drag responsive to an applied voltage. In an embodiment, the spinal resistance assembly 104 includes an eddy current brake. In an embodiment, the spinal resistance assembly 104 includes a ferrofluid configured to change a resistive force in the presence of an applied voltage.

In an embodiment, the spinal resistance assembly 104 includes a friction pad applied to a rotor. In an embodiment, the spinal resistance assembly 104 includes an electormechanical braking pad assembly. In an embodiment, the spinal resistance assembly 104 includes an adjustable mechanical brake.

In an embodiment, the spinal resistance assembly 104 is configured to exert hydraulic resistance by actuation of a propeller in a fluid to resist head and neck rotation of a user about the first axis. In an embodiment, the spinal resistance assembly 104 is configured to exert hydraulic resistance by directing a fluid through a variable orifice to resist head and neck rotation of a user about the first axis. In an embodiment, the spinal resistance assembly 104 is configured to exert pneumatic resistance by directing a fluid through a variable orifice to resist head and neck rotation of a user about the first axis.

In an embodiment, the spinal resistance assembly 104 includes one or more pulleys coupled to at least one weight configured to exert a pull force to resist head and neck rotation of a user about the first axis. In an embodiment, the spinal resistance assembly 104 includes one or more springs configured to exert a pull force to resist head and neck rotation of a user about the first axis. In an embodiment, the spinal resistance assembly 104 includes one or more torque springs configured to resist rotation about the first axis.

In an embodiment, the strengthening device 102 includes a spinal resistance assembly 104 having one or more of a resistance component (e.g., device, mechanism, apparatus, etc.), which may be: a mechanical component, an electromechanical component, a magnetic component, an electromagnetic component, a hydraulic component, and a pneumatic component configured to resist flexion and extension about a second axis. In an embodiment, the spinal resistance assembly 104 includes at least one resistance component configured to resist movement about a third axis different from the first axis and the second axis. In an embodiment, the spinal resistance assembly 104 includes at least one resistance component configured to resist movement about an axis different from the first axis.

In an embodiment, the spinal resistance assembly 104 is further configured to permit flexional and extensional movement of a user about an axis different from the first axis. In an embodiment, the spinal resistance assembly 104 includes at least one of a resistance component (e.g., device, mechanism, apparatus, etc.), which may be: a mechanical component, an electromechanical component, a magnetic component, an electromagnetic component, a hydraulic component, or a pneumatic component configured to resist lateral flexion and extension about a second axis.

In an embodiment, the strengthening device 102 includes a securing assembly 106 configured to anchor the strengthening device 102 to support structure (e.g., a base, stand, supporting structure, anchoring structure, harness worn by the user, squat rack, door frame, bed frame, wall mount, and the like). For example, in an embodiment, the device securing assembly 106 includes mechanical ratchet device 114 configured to friction fit to a door frame.

In an embodiment, the device securing assembly 106 includes a latching structure configured to releasably attach to a base stand. In an embodiment, the device securing assembly 106 includes an adjustable clamping element configured to secure the strengthening device to a door frame.

In an embodiment, the device securing assembly 106 includes one or more fasteners configured to secure the strengthening device to a support structure. Non-limiting examples of fasteners include one or more nuts and bolts, clamps, screws, pins, rivets, hook-and-loop fasteners, hook-and-pile fasteners, touch fasteners, and the like.

In an embodiment, the device securing assembly 106 includes a pneumatic ratchet and clamp device configured to secure the strengthening device to a support structure. In an embodiment, the device securing assembly 106 includes mechanical ratchet device configured to friction fit to a door frame. In an embodiment, the device securing assembly 106 includes a scissor jack configured to at least one of extend, push, lock, or compress against a door frame.

In an embodiment, the device securing assembly 106 includes an adjustable fastening structure configured to secure the strengthening device to a mating structure affixed to a door frame. In an embodiment, the device securing assembly 106 includes an adjustable fastening structure configured to secure the strengthening device to a squat rack. In an embodiment, the device securing assembly 106 includes one or more telescoping arms that lock into place via combination of quick release snap buttons and compression springs. In an embodiment, the device securing assembly 106 includes one or more telescoping arms that lock into place via quick release snap buttons. In an embodiment, the device securing assembly 106 includes one or more telescoping arms that lock into place via compression springs.

In an embodiment, the device securing assembly 106 includes a suction/vacuum seal configured to secure to the door frame. In an embodiment, the device securing assembly 106 includes a suction/vacuum seal configured to secure to the door frame that magnetically couples to magnetic piece receptor piece previously installed on the door frame.

In an embodiment, the strengthening device 102 includes a head affixing assembly 108 having at least one adjustable head strap configured to secure the strengthening device to a user. In an embodiment, the head affixing assembly 108 includes at least one adjustable chin strap configured to secure the strengthening device to a user. In an embodiment, the head affixing assembly 108 includes a self-forming memory foam to custom fit to custom contours of the head. In an embodiment, the head affixing assembly 108 includes one or more inflatable bladders configured to pneumatically secure the device to a user's head.

In an embodiment, the head affixing assembly 108 includes a helmet with internal pneumatic bladders configured to tighten securely around the crown of the head of a user. In an embodiment, the head affixing assembly 108 includes a helmet with internal pneumatic bladders configured to tighten securely around the crown of the head of a user, against the cheekbones and around the base of the skull, sharing a common mechanical interface that latches to a device drive ring.

In an embodiment, the head affixing assembly 108 includes a plate that flank each side of the head that adjusted by a controller (e.g., a screw assembly, an adjustment mechanism, a graduated adjustment mechanism, and the like) to tighten and secure device to the head.

In an embodiment, the strengthening device 102 includes one or more sensors configured to determine position, orientation, resistance, rotation direction, rotation velocity, and the like of the strengthening device 102. Non-limiting examples of sensors include acoustic sensors, charge-coupled devices (CCDs), complementary metal-oxide-semiconductor (CMOS) devices, transducers, optical recognition sensors, detectors, electromagnetic energy sensors, image sensors, infrared sensors, nodes, optical sensors, photodiode arrays, radio frequency components sensors, thermo sensors, transducers, Hall Effect sensors, capacitance sensors, and the like Further non-limiting examples of sensors include angular velocity sensors, gyroscopes, steering angle sensors, rotation speed sensors, yaw-rate sensors, position sensors, and the like.

In an embodiment, the strengthening device 102 includes one or more orientation-aware sensors operably coupled to the strengthening device. For example, in an embodiment, the strengthening device 102 includes one or more multi-axis accelerometers operably coupled to the spinal resistance assembly 104 and configured to determine the position and the orientation of the strengthening device. In an embodiment, the strengthening device 102 includes one or more gyroscopes operably coupled to the strengthening device and configured to generate position and the orientation information.

In an embodiment, the strengthening device 102 includes one or more of angular velocity sensors, steering angle sensors, rotation speed sensors, yaw-rate sensors, position sensors, and nodes. In an embodiment, the strengthening device 102 includes one or more of angular velocity sensors, accelerometers, directional sensors, geographical sensor, inertial navigation sensors, inertial sensors, motion sensors, steering angle sensors, rotation speed sensors, yaw-rate sensors, position sensors, and nodes.

In an embodiment, the strengthening device 102 includes one or more of capacitance sensors, contact sensors, strain sensors, flexure sensors, image sensors, impedance sensors, movement sensors, nodes, object gauge sensors, optical sensors, pressure sensors, transducers, ultrasonic transducers, and the like. In an embodiment, the strengthening device 102 includes one or more sensors configured to assess range of motion. For example, in an embodiment, the strengthening device 102 includes one or more sensors configured to assess range of rotational motion of the spinal resistance assembly 104.

In an embodiment, the strengthening device 102 includes one or more sensors configured to monitor resistance. For example, in an embodiment, the strengthening device 102 includes one or more of integrated sensors (e.g., strain gauge, load cells, and the like) to determine and monitor user applied force, for example, while the user is operating this as the user moves back and forth, the strain gauge will monitor and report applied force. In an embodiment, the feedback from the force measurement is used to manage the applied force by the strengthening device 102 to vary the applied resistance experienced by the user. In an embodiment, a care provider can remotely configure the strengthening device 102 to customize the therapy specific to an individual user's needs (e.g., to limit resistance, allowable rotation, and the like to prevent injury).

In an embodiment, the strengthening device 102 includes one or more of integrated electronic inertial measurement units, digital encoders, and Hall Effect sensors configured to enable determination of position relative to time during use. In an embodiment, the strengthening device 102 includes a plurality of sensors configured to capture time series position information, and force. In an embodiment, the strengthening device 102 includes circuitry including an integrated gyro configured to generate installation and position information.

In an embodiment, the strengthening device 102 communicates collected data to an associated client device that is configured to generate a virtual display of the time series position information. In the embodiment, the client device is configured to display one or more instances of user specific time series position information. In an embodiment, the strengthening device 102 is configured to exchange user-specific acknowledgment or corrective action information with a client device. In an embodiment, the strengthening device 102 is coupled to a client device configured to display an animation that shows one or more of motion vs time information for an individual exercise session, plot range of motion and force averaged over a series of exercise sessions, plot total exercise times and exercise duration per day, week, or month.

In an embodiment, the strengthening device 102 includes circuitry including an inertial sensor configured to detect velocity of motion. In an embodiment, the strengthening device 102 includes circuitry including one or more accelerometers configured to track stability in x, y, and z directions. In an embodiment, the strengthening device 102 includes circuitry including a safety switch configured to control an applied force exerted by the spinal resistance assembly 104 based on a target value.

In an embodiment, a user in need of strengthening therapy will anchor the strengthening device 102, set a resistance value in accordance with the treatment regiment, and secure themselves to the strengthening device 102. In an embodiment, prior to beginning the exercise, the strengthening device 102 will provide feedback (e.g., haptic, audio, visual, etc.) to ensure correct positioning in accordance with the protocol. In an embodiment, as the user begins to rotate head and neck, the strengthening device 102 will resist motion and begin to monitor and report one or more of force, position, time series data, and the like.

In an embodiment, the strengthening device 10 is configured to adjust resistance to comply with a target protocol responsive to one or more inputs associated with the monitored information. For example, in an embodiment, motion information is used to provide one or more of corrective feedback to the user, treatment progress status, applied resistance information, posture, position, compliance information, and the like. In an embodiment, the reported information is communicated to an associated client device and virtually displayed to the user and health provider.

Figure 1C:
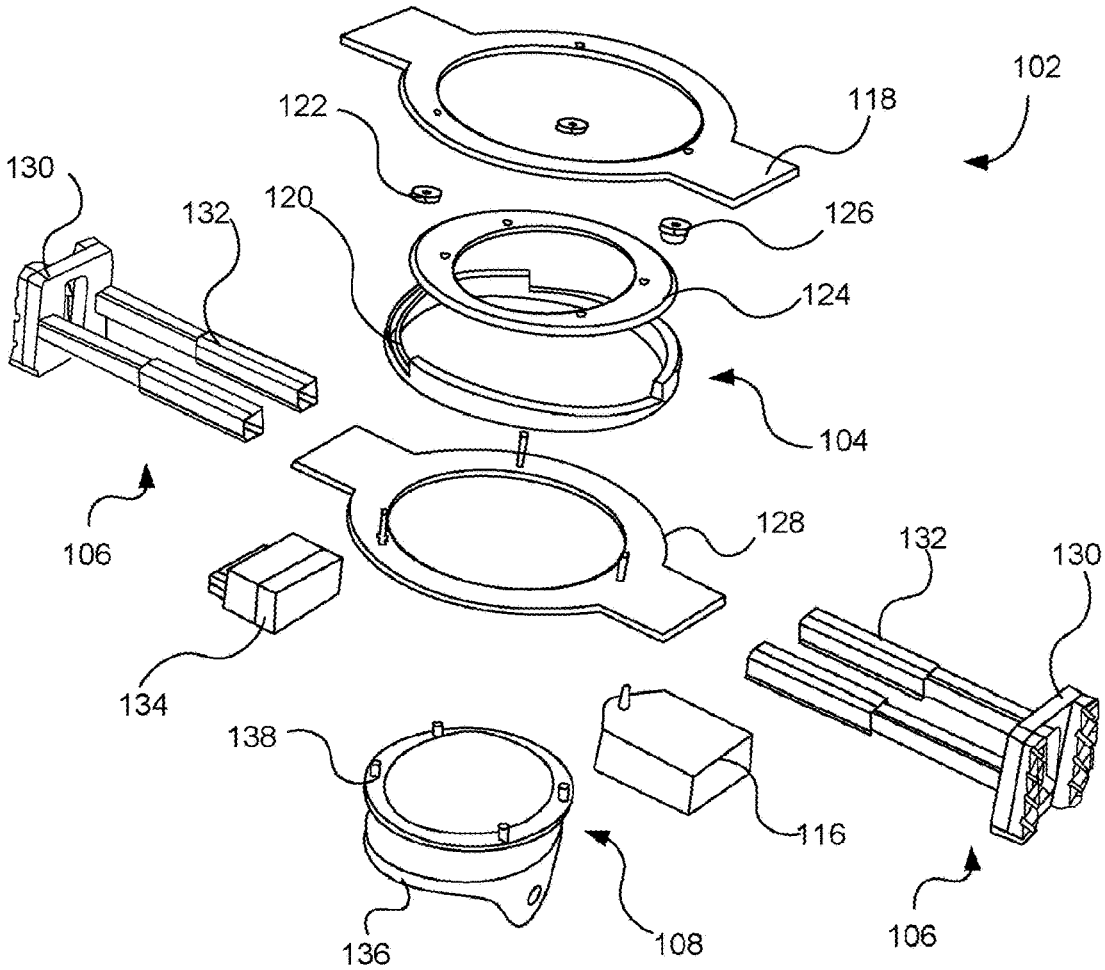
Figure 1D:
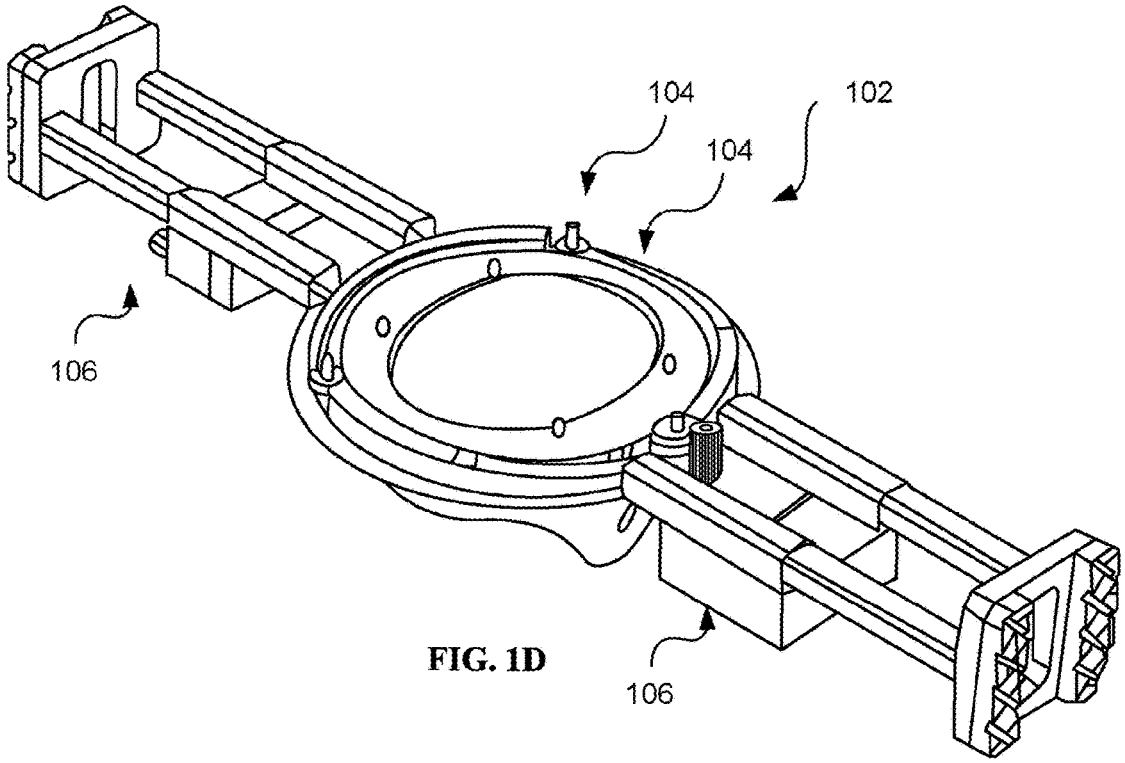
Figure 1E:
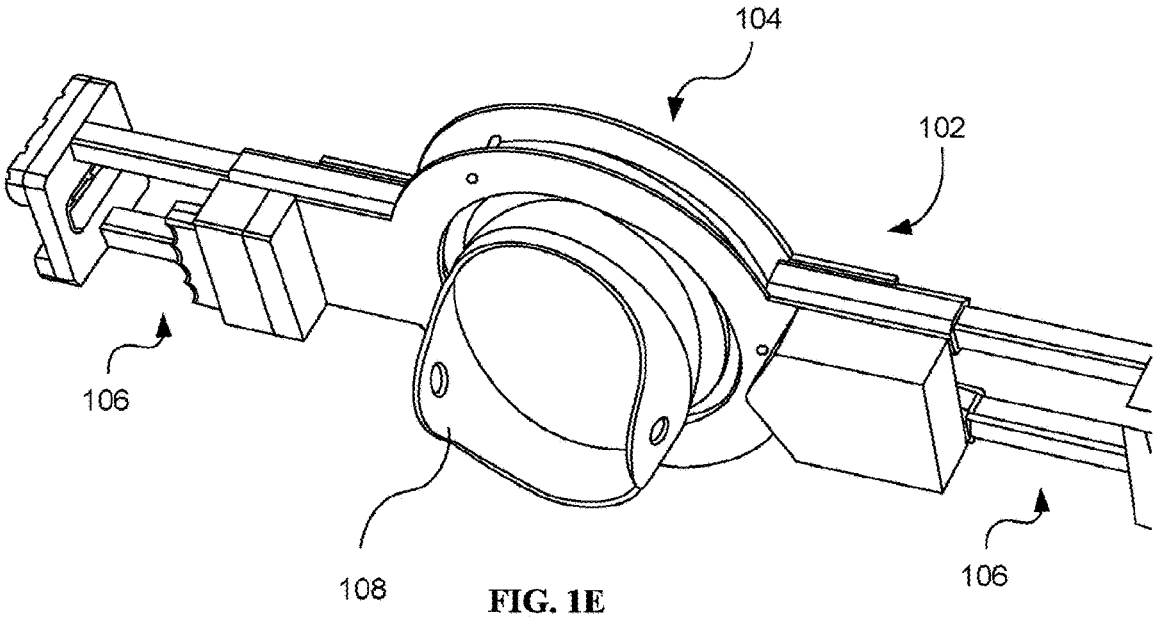

Referring to FIG. 1C, in an embodiment, the spinal resistance assembly 104 includes a resistance component (e.g., device, mechanism, apparatus, etc.) 116 configured to adjust an applied drag force. In an embodiment, the spinal resistance assembly 104 includes one or more of a top plate 118, a traction cam 120, one or more traction cam followers 122, a drive ring 124, drive pinion 126, and a base plate 128.

In an embodiment, the device securing assembly 106 is configured to anchor the strengthening device 102 to support structure (e.g., a base, stand, supporting structure, anchoring structure, harness worn by the user, squat rack, door frame, bed frame, wall mount, and the like). In an embodiment, the device securing assembly 106 includes one or more door frame feet 130. In an embodiment, the device securing assembly 106 includes one or more telescoping arms 132 and at least one telescoping mechanism 134.

In an embodiment, the device securing assembly 106 is configured to adjust the strengthening device 102 along an axis parallel to the spine of the user. In an embodiment, the device securing assembly 106 is configured to adjust the strengthening device 102 towards or away from a user, along an axis parallel to the spine of the user.

In an embodiment, the head affixing assembly 108 includes a head fixture 136 configured to secure to the strengthening device 102 to a user's head. In an embodiment, the head affixing assembly 108 includes head fixture quick releases 138.

Figure 2A:
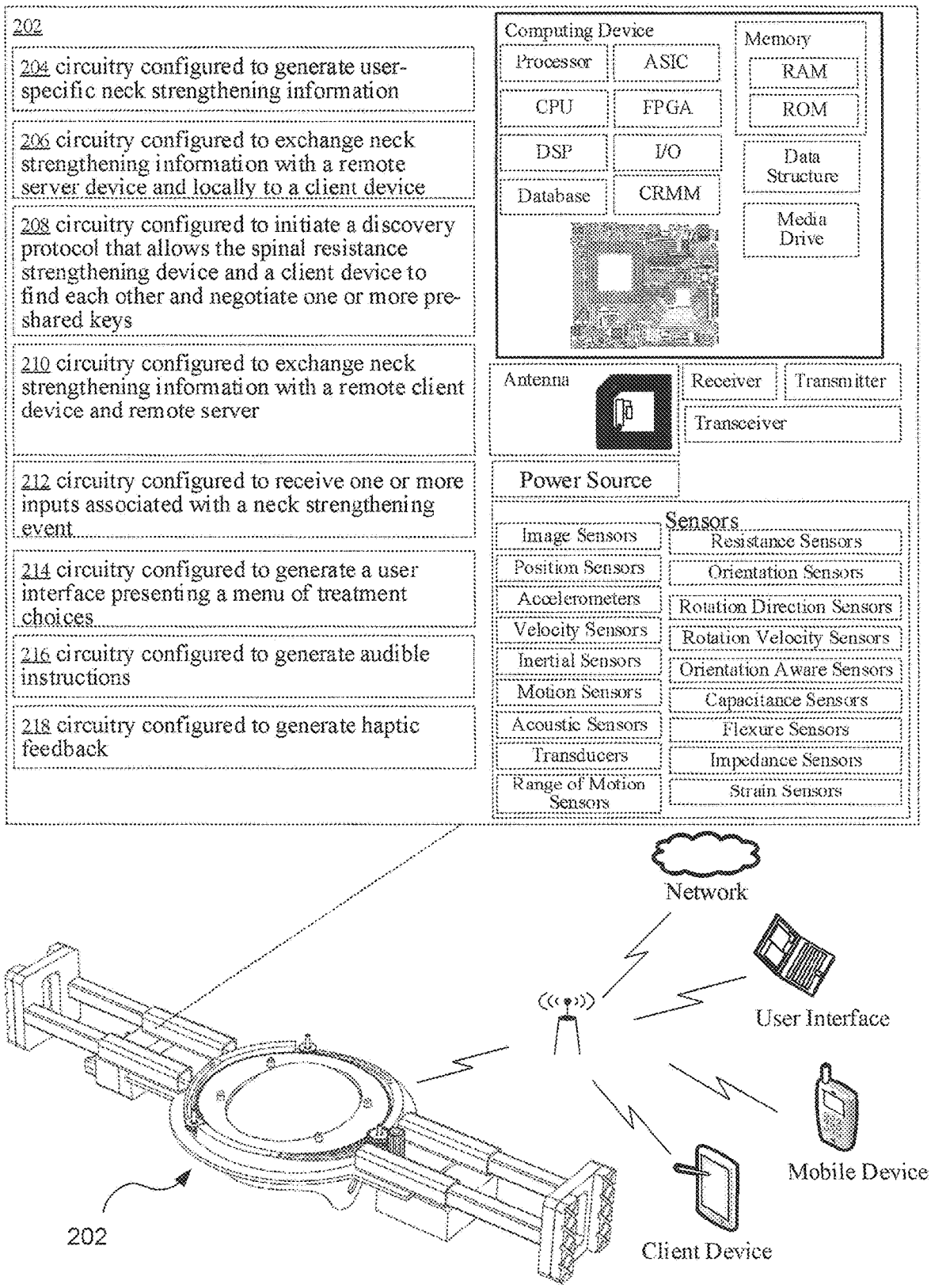
FIGS. 2A and 2B show a spinal resistance strengthening system according to one or more embodiments.
Figure 2B:
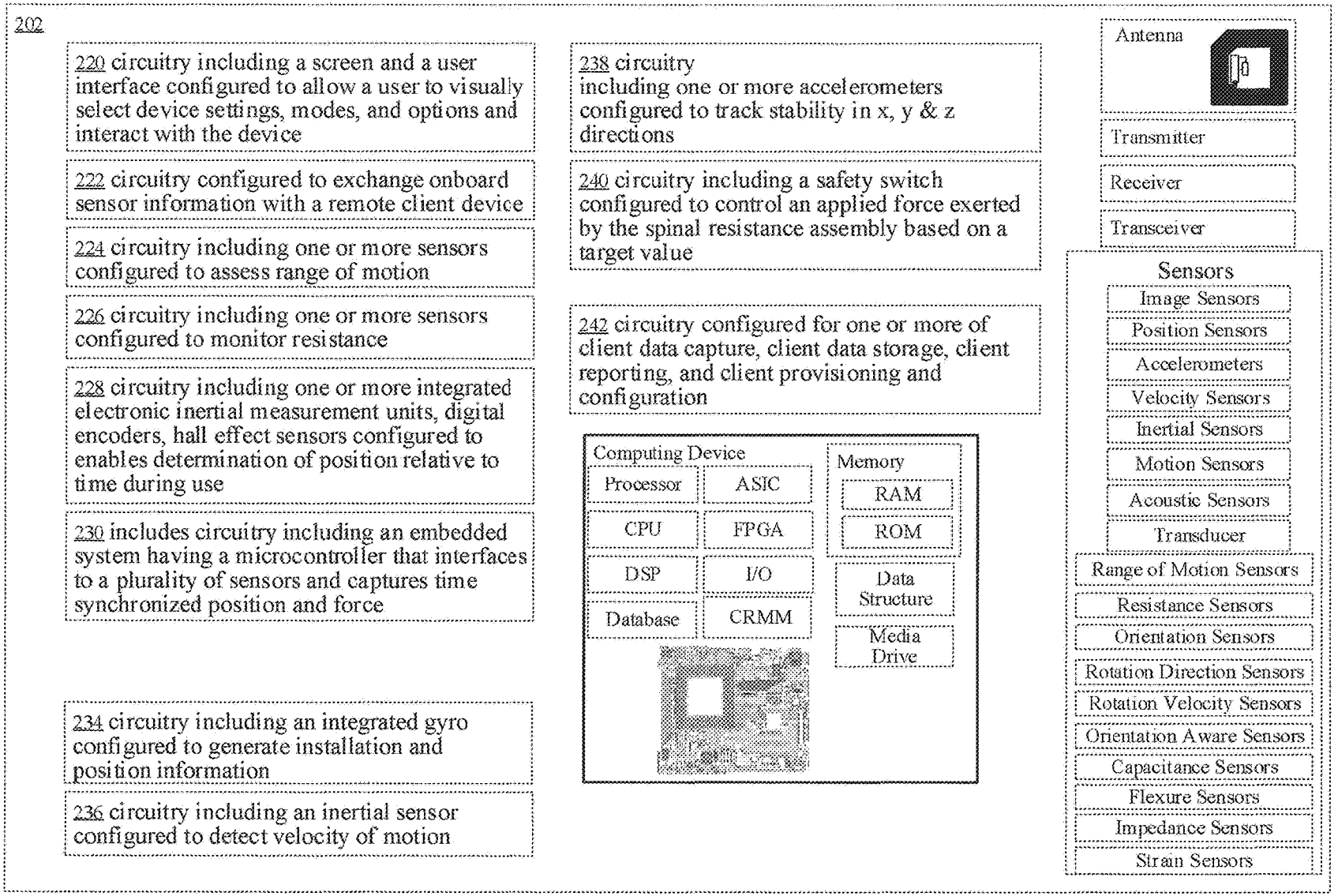

FIGS. 2A and 2B show a spinal resistance strengthening device 202 in which one or more methodologies or technologies can be implemented such as, for example, providing constant resistance to lateral rotation of the cervical spine. In an embodiment, the spinal resistance strengthening device 202 includes circuitry 204 configured generate user-specific neck strengthening information. In an embodiment, the spinal resistance strengthening device 202 includes circuitry 206 configured to exchange neck strengthening information with a remote server device and locally to a client device. Non-limiting examples of client devices include application interface with smart devices, cell phone devices, computer devices, desktop computer devices, internet of things (IoT) devices, laptop computer devices, managed node devices, mobile client devices, notebook computer devices, remote controllers, smart devices, smart eyewear devices, smart wearable devices, tablet devices, wearable devices, and the like.

In an embodiment neck strengthening information includes time stamped position and the associated resistance force magnitude at the provided position that corresponds to user movement and user applied force in the course of executing the exercise protocol. Further non-limiting examples of neck strengthening information include motion vs time for an individual exercise session, range of motion and force averaged over a series of exercise sessions, total exercise times and exercise duration per day, week, or month, and the like.

In an embodiment, the strengthening device 102 is instrumented with an embedded computer via application of an embedded Micro-Processing Unit (MPH) with integrated program memory and custom embedded software. The MPU monitors and controls the exercise system and enables network communication for data exchange between client and server devices. The MPU interface to the system via custom logic, custom analog circuitry, power conversion circuitry, wired and wireless network data communication peripherals, and position and force sensors, and actuators. The embedded computer supports secure data exchange with client and server devices to monitor and set device configuration and monitor and remotely record exercise activity and performance monitoring data.

In an embodiment, circuitry includes, among other things, one or more computing devices such as a processor (e.g., a microprocessor, and the like), a central processing unit (CPU), a digital signal processor (DSP), an application-specific integrated circuit (ASIC), a field programmable gate array (FPGA), or the like, or any combinations thereof, and can include discrete digital or analog circuit elements or electronics, or combinations thereof. In an embodiment, circuitry includes one or more ASICs having a plurality of predefined logic components. In an embodiment, circuitry includes one or more FPGAs having a plurality of programmable logic components. In an embodiment, circuitry includes one or more remotely located components. In an embodiment, remotely located components are operably coupled via wireless communication. In an embodiment, remotely located components are operably coupled via one or more receivers, transceivers, or transmitters, or the like.

In an embodiment, the strengthening device 102 includes circuitry having one or more components operably coupled (e.g., communicatively, electromagnetically, magnetically, ultrasonically, optically, inductively, electrically, capacitively coupled, and the like) to each other. In an embodiment, a component includes one or more remotely located components. In an embodiment, remotely located components are operably coupled, for example, via wireless communication. In an embodiment, remotely located components are operably coupled, for example, via one or more receivers, transmitters, transceivers, antennas, or the like.

In an embodiment, circuitry includes one or more memory devices that, for example, store instructions or data. For example, in an embodiment, circuitry 204 configured generate user-specific neck strengthening information includes one or more memory devices that store one or more parameters associated a user-specific neck strengthening information event, and the like. Non-limiting examples of one or more memory devices include volatile memory (e.g., Random Access Memory (RAM), Dynamic Random-Access Memory (DRAM), or the like), non-volatile memory (e.g., Read-Only Memory (ROM), Electrically Erasable Programmable Read-Only Memory (Flash memory), or the like), persistent memory, or the like. The one or more memory devices can be coupled to, for example, one or more computing devices by one or more instructions, data, or power buses.

In an embodiment, where applicable, circuitry includes peripheral devices such as Bluetooth, Wi-Fi, USB (or other wireless or wired network communication peripherals cable of data exchange with remote client and server computers), and cellular connectivity to exchange data, exchange control commands, configure the device, and remotely monitor device parameters.

In an embodiment, circuitry includes one or more user input/output components that are operably coupled to the device to generate a user interface that enables access to all user configurable parameters.

In an embodiment, circuitry includes computing circuitry, memory circuitry, electrical circuitry, electro-mechanical circuitry, control circuitry, transceiver circuitry, transmitter circuitry, receiver circuitry, and the like. For example, in an embodiment, circuitry 206 configured to exchange neck strengthening information with a remote client device includes computing device circuitry, memory circuitry, and at least one of transceiver circuitry, transmitter circuitry, or receiver circuitry.

In an embodiment, the spinal resistance strengthening device 202 includes circuitry 208 configured to initiate a discovery protocol that allows the spinal resistance strengthening device and a client device to find each other and negotiate one or more pre-shared keys to provide an encrypted secure connection. Individual devices will be configured in hardware with a unique identifier to establish a secure IoT connection. In an embodiment, the spinal resistance strengthening device 202 includes circuitry 210 configured to exchange neck strengthening information with a remote client device and remote server. In an embodiment, the spinal resistance strengthening device 202 includes circuitry 212 configured to receive one or more inputs associated with a neck strengthening event.

In an embodiment, the spinal resistance strengthening device 202 includes circuitry 214 configured to generate a user interface presenting a menu of treatment choices. In an embodiment, the spinal resistance strengthening device 202 includes circuitry 216 configured to generate audible instructions. In an embodiment, the spinal resistance strengthening device 202 includes circuitry 218 configured to generate haptic feedback. In an embodiment, the spinal resistance strengthening device 202 includes circuitry 220 including a screen and a user interface configured to allow a user to visually select device settings, modes, and options and interact with the device.

In an embodiment, the spinal resistance strengthening device 202 includes circuitry 222 configured to exchange onboard sensor information with a remote client device. In an embodiment, the spinal resistance strengthening device 202 includes circuitry 224 including one or more sensors configured to assess range of motion. In an embodiment, the spinal resistance strengthening device 202 includes circuitry 226 including one or more sensors configured to monitor resistance.

In an embodiment, the spinal resistance strengthening device 202 includes circuitry 228 including one or more integrated electronic inertial measurement units, digital encoders, hall effect sensors configured to enables determination of position relative to time during use. In an embodiment, the spinal resistance strengthening device 202 includes circuitry 230 including an embedded system having a microcontroller that interfaces to a plurality of sensors and captures time synchronized position and force. In an embodiment, the spinal resistance strengthening device 202 includes circuitry 232 configured to exchange onboard sensor information with a remote client device.

In an embodiment, the spinal resistance strengthening device 202 includes circuitry 234 including an integrated gyro configured to generate installation and position information. In an embodiment, the spinal resistance strengthening device 202 includes circuitry 236 including an inertial sensor configured to detect velocity of motion.

In an embodiment, the spinal resistance strengthening device 202 includes circuitry 238 including one or more accelerometers configured to track stability in x, y, and z directions. In an embodiment, the spinal resistance strengthening device 202 includes circuitry 240 including a safety switch configured to control an applied force exerted by the spinal resistance assembly 104 based on a target value.

In an embodiment, the spinal resistance strengthening device 202 supports data exchange with a remote computer server that monitors and records user specific exercise performance data. In an embodiment, the remote server executes a custom application that enabled user specific data storage, retrieval, configuration, and reporting. For example, in an embodiment, the spinal resistance strengthening device 202 includes host computational circuitry 242 configured for one or more of client data capture, client data storage, client reporting, and client provisioning and configuration. In an embodiment, the host computational circuitry 242 includes account management circuitry configured to allow one or more of creation, deletion, and modification and secure client account access grouped under a care provider as administrator for viewing client exercise data and creating customized reports.

In an embodiment, the host server computational circuitry 242 includes circuitry including memory configured to store client data. In an embodiment, the host computational circuitry 242 includes a reporting tool that allows creation of customizable reports for individual clients and groups of clients assigned to the care provider. In an embodiment, the host computational circuitry 242 includes a client portal allows individual clients to track user-specific progress. In an embodiment, the host computational circuitry 242 includes a customized reporting screen that allow monitoring of individual patient exercise progress over time.

In an embodiment, during operation, a care provider can play an animation that displays motion vs time for an individual exercise session, plot range of motion and force averaged over a series of exercise sessions, plot total exercise times and exercise duration per day, week, or month.

In an embodiment, the host computational circuitry 242 includes configuration tools that allow monitoring and management of client device features and client device configuration. In an embodiment, the host computational circuitry 242 includes an expert system that analyzes client data for proper execution and adherence to a prescribed exercise protocol.

In an embodiment, the host computational circuitry 242 includes circuitry configured to generate an electronic message to a client with customized messages for acknowledgment or corrective action.

Figure 3:
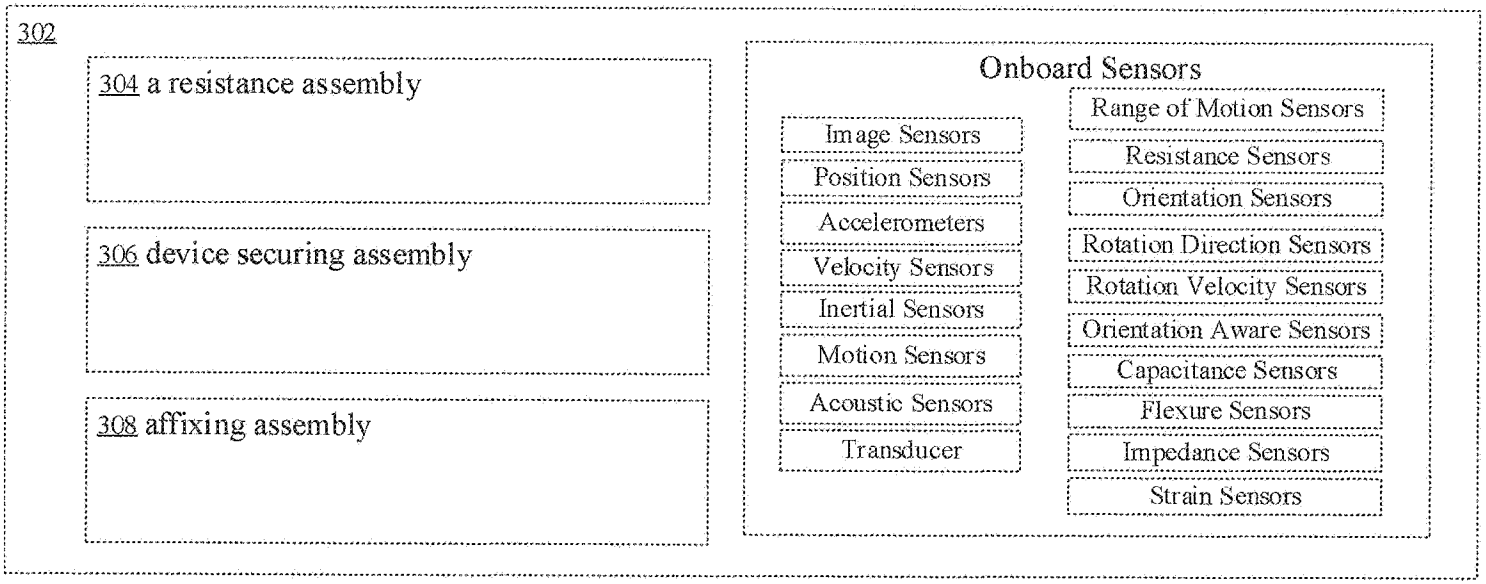
FIG. 3 is a block diagram of a strengthening device according to an embodiment.

FIG. 3 shows a strengthening device 302 in which one or more methodologies or technologies can be implemented such as, for example, providing constant resistance to one or more of flexional and extensional movement, lateral flexion and extension, and lateral rotation of a body part. In an embodiment, the strengthening device 302 includes a resistance assembly 304 including at least one resistance component configured to resist rotation about a first axis.

In an embodiment, the strengthening device 302 can not only be used to strengthen the cervical spine, but can be converted to strengthen other rotational joints such as the shoulder, knee, hip, etc. For example, in an embodiment, the resistance assembly 304 includes at least one of a mechanical component, electromechanical component, magnetic component, electromagnetic component, hydraulic component, or a pneumatic component configured to resist flexion and extension about a second axis. In an embodiment, the resistance assembly 304 includes at least one resistance component configured to resist movement about a third axis different from the first axis and the second axis. In an embodiment, the resistance assembly 304 includes at least one resistance component configured to resist movement about an axis different from the first axis. In an embodiment, the resistance assembly 304 is further configured to permit flexional and extensional movement of a user about an axis different from the first axis.

In an embodiment, the resistance assembly 304 includes at least one of a mechanical component, electromechanical component, magnetic component, electromagnetic component, hydraulic component, or a pneumatic component configured to resist lateral flexion and extension about a second axis.

In an embodiment, the strengthening device 302 includes a device securing assembly 306 configured to physically anchor the device to an anchoring structure.

In an embodiment, the strengthening device 302 includes an affixing assembly 308 physically coupled to the resistance assembly 304, the affixing assembly 308 configured to secure to a body part of a user.

FIG. 4 shows a spinal strengthening method 400. At 410, the method 400 includes securing a user to a head affixing assembly physically coupled to a spinal resistance assembly.

At 420, the method 400 includes applying a resistive force responsive to head and neck rotation of a user about a first axis. At 422, applying the resistive force responsive to head and neck rotation includes exerting a drag force on a metal structure to resist head and neck rotation of the user about the first axis. At 424, applying the resistive force responsive to head and neck rotation includes adjusting an applied drag force by modulating a magnetic field to resist head and neck rotation of the user about the first axis. At 426, applying the resistive force responsive to head and neck rotation includes exerting a hydraulic resistance by directing a fluid through a variable orifice to resist head and neck rotation of a user about the first axis. At 428, applying the resistive force responsive to head and neck rotation includes exerting pneumatic resistance by directing a fluid through a variable orifice to resist head and neck rotation of the user about the first axis. At 430, applying the resistive force responsive to head and neck rotation includes exerting a mechanical pull force to resist head and neck rotation of the user about the first axis. At 432, applying the resistive force responsive to head and neck rotation includes applying a force of character and for a duration sufficient to permit left and right lateral neck rotation of the user about the first axis while substantially limiting flexional and extensional movement.

At 440, the method 400 includes securing the spinal resistance assembly to an anchoring structure. At 442, securing the spinal resistance assembly to the anchoring structure includes friction fitting the spinal resistance assembly to a door frame. At 444, securing the spinal resistance assembly to the anchoring structure includes latching the spinal resistance assembly to a base stand. At 446, securing the spinal resistance assembly to the anchoring structure includes clamping the spinal resistance assembly to a door frame. At 448, securing the spinal resistance assembly to the anchoring structure includes fastening the spinal resistance assembly to a support structure.

Figure 5A:
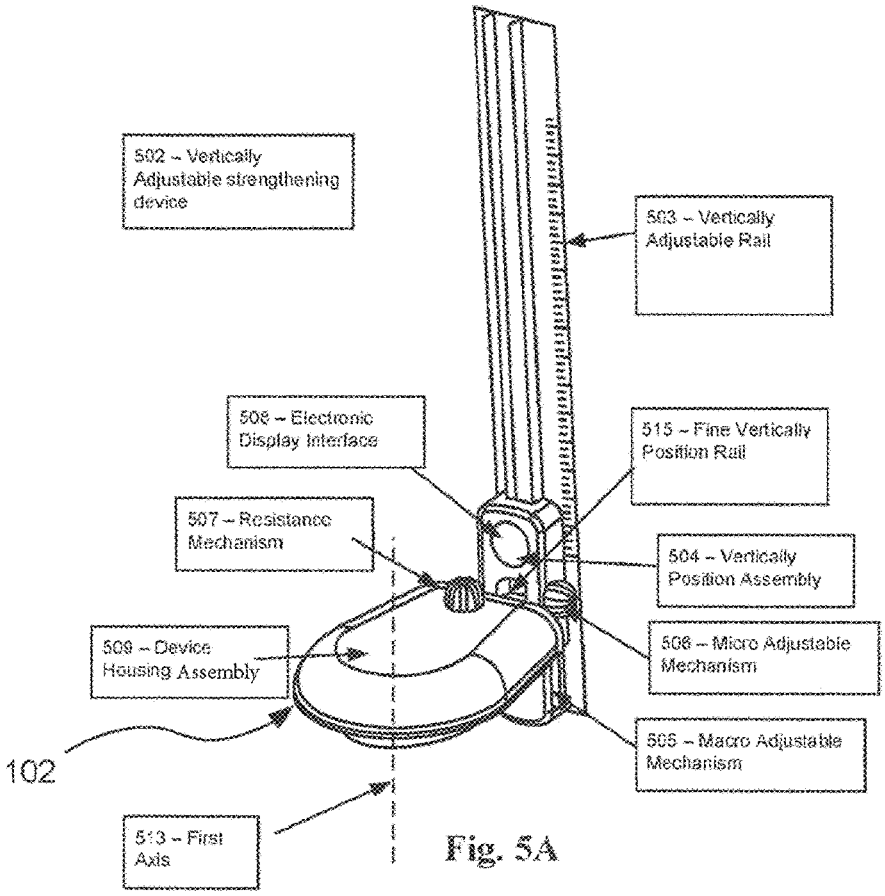
FIGS. 5A, 5B, and 5C show a spinal resistance strengthening system according to one or more embodiments.
Figure 5B:
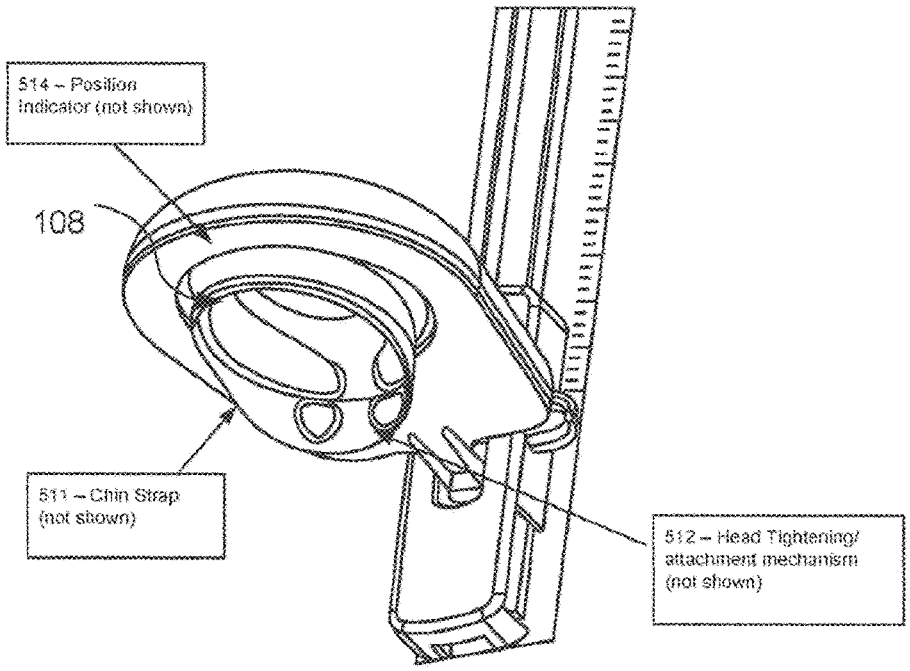
Figure 5C:
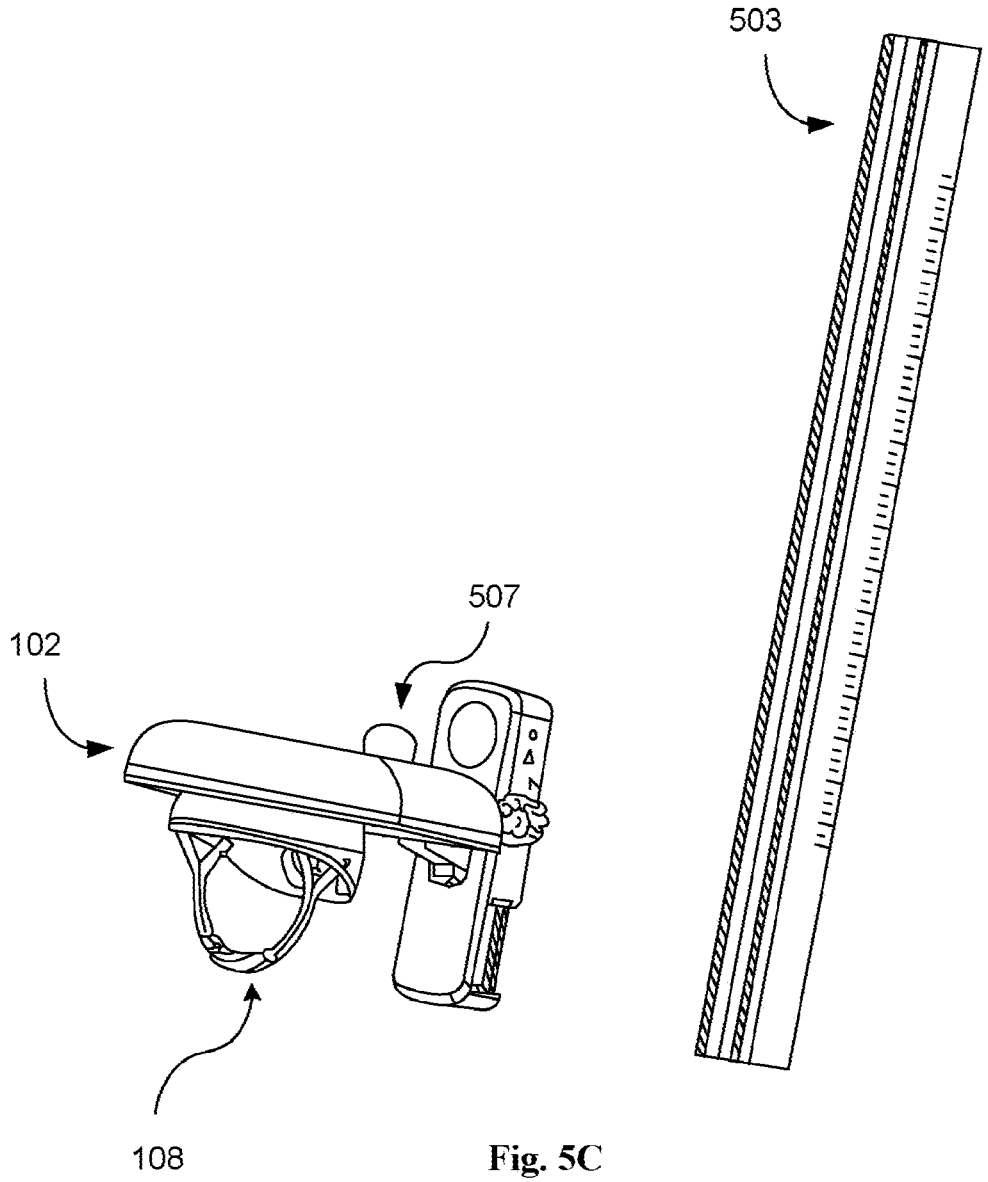

FIGS. 5A, 5B, and 5C show a strengthening device 502 which is adjustable along an axis substantially parallel to the spine of a user, in which one or more methodologies or technologies can be implemented such as, for example, providing constant resistance to lateral rotation of the cervical spine. In an embodiment, wherein the user is seated or standing, the vertically adjustable strengthening device 502 includes a spinal resistance assembly, as described above with respect to spinal resistance assembly 104, including at least one resistance component (such as is labeled in FIG. 5A, for example, resistance mechanism 507) configured to resist rotation about a first axis 513. In an embodiment, Vertical Adjustment rail 503 is configured to mount to a wall.

In an embodiment, the device securing assembly 106 includes one or more fasteners configured to secure the strengthening device to a support structure. Non-limiting examples of fasteners include one or more nuts and bolts, clamps, screws, pins, rivets, hook-and-loop fasteners, hook-and-pile fasteners, touch fasteners, and the like.

In an embodiment, Vertical Adjustment Rail 503, is composed of a vertically orientated rail that physically couples to Vertical Positioning Assembly 504. The geometry of Adjustment and permanently coupling rail 503 guides the vertical motion and physically couples to Vertical Positioning Assembly 504, so that's its height can be set at a point to be used by a patient.

In an embodiment, Vertical Adjustment Rail 503, contains a measurement scale to indicate the relative height in which Vertical Positioning Assembly 504 can be positioned.

In an embodiment, Vertical Positioning Assembly 504, contains three subsystems; Macro Adjustment Mechanism 505, Micro Adjustment Mechanism 506 and Electronic Display Interface 508. In an embodiment, Vertical Positioning Assembly 504, couples to Device Housing Assembly 509.

In an embodiment, Vertical Positioning Assembly 504, has a marker that indicates a relative positioned on the measurement scale on Vertical Adjustment Rail 503. In an embodiment, Device Housing Assembly 509, couples to a Head Interface 510 and a Resistance Mechanism 507. In an embodiment, Device Housing Assembly 509, a patient is attached to the Head Interface 512, and rotates about First Axis 513, and consists of a position indicator 514 that includes a LED array connected along the arc of travel to guide a user to constant angular velocity.

In an embodiment, Device Housing Assembly 509, a patient is attached to the Head Interface 512, and rotates about First Axis 513, an audio cue (i.e. counter, metronome), indicates use to move at a constant angular velocity.

In an embodiment, Device Housing Assembly 509, a patient is attached to the Head Interface 512, and rotates about First Axis 513, and consists of a position indicator 514 that includes a mechanical component that attaches to Head Interface 512, that indicates position relative to a static origin position.

In an embodiment, position indicator 514, contains a method indicating position of rotation in each direction (clockwise and counter-clockwise) about the first axis 513, by an array of LED lights. In an embodiment, position indicator 514, contains a method of indicating position of rotation in each direction (clockwise and counter-clockwise) about the first axis 513, by angular measurements marked relative to an origin. In an embodiment, position indicator 514, contains a method to indicate position of rotation in each direction (clockwise and counter-clockwise) about the first axis 513, by audible or visual cue when intended range of motion is exceeded. In an embodiment, head affixing assembly 108, contains a Chin Strap 511 and a Head Tightening Attachment Mechanism 512 that allows a patient to connect to Vertically Adjustable Strengthening device 502 per the size and/or position of their head.

In an embodiment, Macro Adjustment Mechanism 505, contains two handles that can be locked and unlocked to the Vertical Adjustment Rail 503 via combination of springs, pins and locking holes.

In an embodiment, Macro Adjustment Mechanism 505, contains two handles that be locked and unlocked to the Vertical Adjustment Rail 503 via a combination brake pad, springs and pins. In an embodiment, Macro Adjustment Mechanism 505, contains two handles that when in the unlocked position can easily move vertically along the Vertical Adjustment Rail 503.

In an embodiment, Macro Adjustment Mechanism 505, combination of springs, pins and locking holes that can lock and unlock to Vertical Adjustment Rail 503. In an embodiment, Macro Adjustment Mechanism 505, contains a combination of gears (spur, worm, bevel, etc.) and a rack powered by a motor (DC, Servo, Hydraulic, Pneumatic, etc.) that translates to rapid vertical motion along Vertical Adjustment Rail 503. In an embodiment, Macro Adjustment Mechanism 505, contains a combination of gears (spur, worm, bevel, etc.) and a rack that is manually (non-motor/power controlled) controlled via input crank/knob that translates to rapid vertical motion along Vertical Adjustment Rail 503.

In an embodiment, Micro Adjustment Mechanism 506, contains a controller that translates to fine vertical motion of Vertical Positioning Assembly 504 along Fine Vertical Adjustment Rail 515. In an embodiment, Micro Adjustment Mechanism 506, contains a combination of gears (spur, worm, bevel, etc.) and a rack that translates to fine vertical motion along Fine Vertical Adjustment Rail 515. In an embodiment, Micro Adjustment Mechanism 506, contains a combination of gears (spur, worm, bevel, etc.) and a rack powered by a motor (DC, Servo, Hydraulic, Pneumatic, etc.) that translates to rapid vertical motion along Fine Vertical Adjustment Rail 515.

Figure 6A:
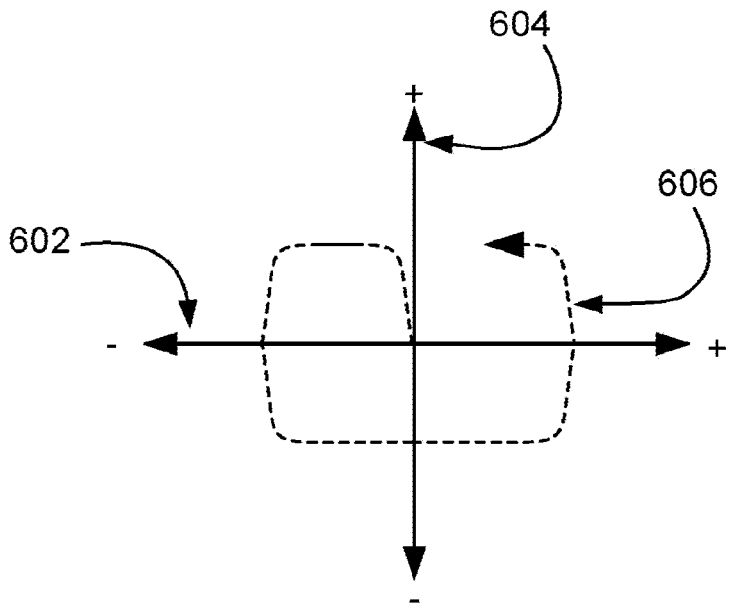
FIGS. 6A and 6B show an analytics representation for a spinal resistance strengthening system according to one or more embodiments.

To put the aforementioned sensors and analysis in context FIG. 6A illustrates a simple example of the type of analytic typical of a local Bluetooth linked cell phone application making use of the sensors in some embodiments. FIG. 6A shows what one might expect of plotting the head's position (602) with respect to the resistive force being applied (604) restricting head movement for a magnetic force due to parasitic eddy current torque. The dashed line (606) shows an actual measurement one could plot for one cycle of head rotation.

With the head in the initial rest position the opposing resistive force is zero. As the head starts to rotate the opposing force quickly rises to a fixed level as controlled by a feedback of the sensors to control the strength of the magnetic field to a pre-determined constant force. As the head reaches the extreme limit of rotation and stops the force again falls to zero then changes polarity as the head moves in the opposite direction. At the other extreme it reverses again.

Figure 6B:
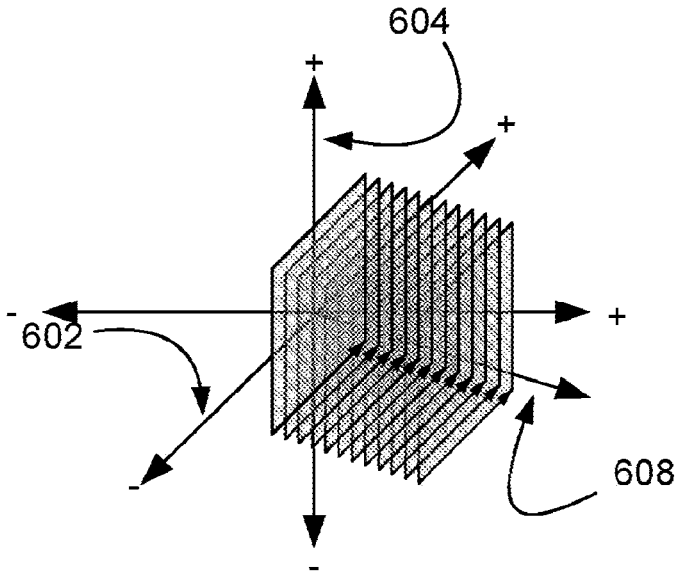

FIG. 6B shows an idealized example of a "profile" one could generate graphically on a local cell phone application, in a more sophisticated environment elsewhere, if the plot is recorded over time (608) as the third axis in a three-dimensional (3D) plot. The 3D plot is useful as a graphic portrayal of how the subject is performing over the length of a session. The example in FIG. 6B is highly idealistic, with each cycle the same, when in a real situation one would see the effect of physical defects or lack of them in as well.

The profile is a graphic representation of the measurements made and requires no human intervention and is manipulated as a simple 3D picture for later interpretation. In this respect it would be equivalent to "fingerprint" or a "signature" of a physical condition such as a cardiogram is for the heart.

Throughout this description used position and force as the two axis of the plot and profile, one could certainly choose two or more other types of sensors with a meaningful relationship to create a different set of plots and profiles.

The herein described subject matter sometimes illustrates different components contained within, or connected with, different other components. It is to be understood that such depicted architectures are merely examples, and that in fact, many other architectures can be implemented that achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably coupleable," to each other to achieve the desired functionality Specific examples of operably coupleable include, but are not limited to, physically mateable, physically interacting components, wirelessly interactable, wirelessly interacting components, logically interacting, logically interactable components, etc.

In an embodiment, one or more components may be referred to herein as "configured to," "configurable to," "operable/operative to," "adapted/adaptable," "able to," "conformable/conformed to," etc. Such terms (e.g., "configured to") can generally encompass active-state components, or inactive-state components, or standby-state components, unless context requires otherwise.

The foregoing detailed description has set forth various embodiments of the devices or processes via the use of block diagrams, flowcharts, or examples. Insofar as such block diagrams, flowcharts, or examples contain one or more functions or operations, it will be understood by the reader that each function or operation within such block diagrams, flowcharts, or examples can be implemented, individually or collectively, by a wide range of hardware, software, firmware in one or more machines or articles of manufacture, or virtually any combination thereof. Further, the use of "Start," "End," or "Stop" blocks in the block diagrams is not intended to indicate a limitation on the beginning or end of any functions in the diagram. Such flowcharts or diagrams may be incorporated into other flowcharts or diagrams where additional functions are performed before or after the functions shown in the diagrams of this application. In an embodiment, several portions of the subject matter described herein is implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry or writing the code for the software and or firmware would be well within the skill of one of skill in the art in light of this disclosure. In addition, the mechanisms of the subject matter described herein are capable of being distributed as a program product in a variety of forms, and that an illustrative embodiment of the subject matter described herein applies regardless of the particular type of signal-bearing medium used to actually carry out the distribution. Non-limiting examples of a signal-bearing medium include the following: a recordable type medium such as magnetic data storage media, non-volatile memory drive "Solid state drive," any potable data storage media, a hard disk drive, a Compact Disc (CD), a Digital Video Disk (DVD), a digital tape, a computer memory, etc.; and a transmission type medium such as a program distribution via remote download over any wired or wireless network.

While aspects of the present subject matter described herein have been shown and described, it will be apparent to the reader that, based upon the teachings herein, changes and modifications can be made without departing from the subject matter described herein and its broader aspects and, therefore, the appended claims are to encompass within their scope all such changes and modifications as are within the true spirit and scope of the subject matter described herein. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). Further, if a specific number of an introduced claim recitation is intended, such an intent will be explicitly recited in the claim, and in the absence of such recitation no such intent is present.

For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense of the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense of the convention (e.g., "a system having at least one of A, B, or C" would include but not be limited to systems that have A alone, B alone, C alone, A and B together, A and C together, B and C together, and/or A, B, and C together, etc.). Typically, a disjunctive word or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, the operations recited therein generally may be performed in any order. Also, although various operational flows are presented in a sequence(s), the various operations may be performed in orders other than those that are illustrated, or may be performed concurrently. Examples of such alternate orderings includes overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. An orthopedic device comprising:

a head strap configured to engage with a head of a user;

one or more sensors configured to determine a position of the head or a neck of the user; and a spinal resistance assembly comprising a first axis and a resistance component, wherein the resistance component comprises an eddy current brake;

wherein the resistance component is configured to apply a resistive force to the head or the neck of the user about the first axis responsive to a determined movement of the head or the neck of the user via the one or more sensors; and wherein the applied resistive force is maintained at a pre-determined constant force value using feedback of the one or more sensors.

2. The orthopedic device of claim 1, wherein the device is configured to be anchored to a structure.

3. The orthopedic device of claim 1, wherein the at least one sensor comprises at least one of an image sensor, a position sensor, an accelerometer, a velocity sensor, an inertial sensor, a motion sensor, an acoustic sensor, a transducer, a resistance sensor, an orientation sensor, a rotation direction sensor, a rotation velocity sensor, an orientation aware sensor, a flexure sensor, a capacitance sensor, an impedance sensor, a range of motion sensor, or a strain sensor.

4. The orthopedic device of claim 1, wherein the first axis is configured to be oriented parallel to a spine of the user, and wherein the resistive force is configured to permit lateral neck rotation of the user about the first axis and limit flexional and extensional movement of the head and the neck of the user.

5. A system comprising:

a computing device comprising a user interface;

an orthopedic device comprising a head strap, at least one sensor, and a spinal resistance assembly;

wherein the head strap is configured to engage with a head of a user of the orthopedic device, the at least one sensor is configured to generate position data based on a determined position of the head or a neck of the user, and the spinal resistance assembly comprises a first axis and a resistance component, wherein the resistance component comprises an eddy current brake, wherein the resistance component is configured to apply a resistive force to the head or the neck of the user about the first axis responsive to a determined movement of the head or the neck of the user via the at least one sensor, wherein the applied resistive force is maintained at a pre-determined constant force value using feedback of the at least one sensor;

wherein the spinal resistance assembly is communicatively coupled to the head strap; and a server system communicatively coupled to the computing device, the server system comprising a non-transitory memory comprising computer program code and a processor, wherein execution of the computer program code causes the server system to:

receive, from the computing device, a target resistance value, receive, from the at least one sensor, position data, generate applied force parameters based on the target resistance value and the position data, and transmit the generated applied force parameters from the server system to the orthopedic device.

6. The system of claim 5, wherein the orthopedic device is configured to apply the resistive force to at least one of the head or the neck of the user about the first axis responsive to receiving the target resistance value and the position data.

7. The system of claim 5, wherein the server system is configured to:

generate a graphic for at least one of motion-time, motion-force, exercise time, or exercise duration over a pre-determined time period based on the received position data; and transmit the graphic to the user interface; and wherein the user interface is configured to display the generated graphic.

8. The system of claim 5, wherein the at least one sensor comprises at least one of an image sensor, a position sensor, an accelerometer, a velocity sensor, an inertial sensor, a motion sensor, an acoustic sensor, a transducer, a resistance sensor, an orientation sensor, a rotation direction sensor, a rotation velocity sensor, an orientation aware sensor, a flexure sensor, a capacitance sensor, an impedance sensor, a range of motion sensor, or a strain sensor.

9. The system of claim 5, wherein the user interface is configured to provide the user of the orthopedic device movement corrective feedback indicating a target location for a position of the head of the user.

10. A method comprising:

engaging a head a strap of an orthopedic device with a head of a user of the orthopedic device, wherein the orthopedic device comprises a spinal resistance assembly coupled to the head strap and a sensor, wherein the spinal resistance assembly comprises a first axis and a resistance component, wherein the resistance component comprises an eddy current brake;

determining, via the sensor, a position of the head of the user;

applying a drag resistive force to at least one of the head or a neck of the user, via the eddy current brake of the spinal resistance assembly, about the first axis responsive to determining a movement of at least one of the head or the neck of the user via the sensor; and maintaining the drag resistive force at a pre-determined constant force value using feedback of the sensor.

11. The method of claim 10, further comprising: anchoring the orthopedic device to an anchoring structure.

12. The method of claim 10, wherein applying the drag resistive force comprises exerting or adjusting the drag resistive force by modulating a magnetic field to resist head and neck rotation of the user about the first axis.

* * * * *